1/5/88 XR 4,716,967

United States Patent [19]

Mohaupt

[11] Patent Number: 4,716,967

[45] Date of Patent: Jan. 5, 1988

[54] STIMULATING SUBTERRANEAN FORMATIONS IN THE OPEN HOLE

[76] Inventor: Henry H. Mohaupt, 1151 Estrella Dr., Santa Barbara, Calif. 93110

[21] Appl. No.: 732,967

[22] Filed: May 13, 1985

[51] Int. Cl.[4] ..... E21B 43/25; E21B 43/26; E21B 43/263

[52] U.S. Cl. ..... 166/305.1; 166/63; 166/299; 166/308

[58] Field of Search ..... 166/262, 63, 299, 305.1, 166/303, 308; 102/313

[56] References Cited

U.S. PATENT DOCUMENTS

| | | | |
|---|---|---|---|
| 3,561,532 | 2/1971 | Fletcher et al. | 166/299 |
| 3,587,744 | 6/1971 | Spencer et al. | 166/299 |
| 3,610,150 | 10/1971 | Teichmann | 102/313 |
| 3,630,281 | 11/1971 | Fast et al. | 166/299 |
| 3,999,609 | 12/1976 | Field | 166/299 |
| 4,039,030 | 8/1977 | Godfrey et al. | 166/299 |
| 4,360,062 | 11/1982 | Browning | 166/299 |
| 4,380,265 | 4/1983 | Mohaupt | 166/260 |
| 4,530,396 | 7/1985 | Mohaupt | 166/63 |

*Primary Examiner*—Stephen J. Novosad
*Assistant Examiner*—Bruce M. Kisliuk
*Attorney, Agent, or Firm*—G. Turner Moller

[57] ABSTRACT

A subterranean formation is fractured by burning a quantity of fuel in an uncased bore hole to generate a large quantity of high pressure combustion products. These gases rapidly flow into the formation creating the fractures. The device is assembled in the well by placing a thermal ignitor in the well and delivering a quantity of fuel and oxidizer around the ignitor. The fuel and oxidizer comprise a flowable material and are either pumped or poured into the well.

18 Claims, 8 Drawing Figures

STIMULATING SUBTERRANEAN FORMATIONS IN THE OPEN HOLE

This invention relates to a technique for stimulating subterranean formations, such as those containing hydrocarbons, in the open hole, i.e. in a section of the well bore which is not cased.

At the present time, almost all stimulations of hydrocarbon producing wells are conducted in cased holes, i.e. where steel casing has been cemented in the well bore and perforations provided between the interior of the casing and the formation desired to be stimulated. In most areas, this is imminiently sensible since the productive formation may be relatively thin and relatively close to a water bearing formation. Conventional completion techniques, including casing the well and perforating the desired interval, act to direct the stimulating technique to the vertical section of the hole where it is desired. Because of the inability to control or direct the stimulating efforts, attempted stimulation efforts in the open hole at this period of development is unusual in most parts of the world.

There are, however, some parts of the world where oil field completions are habitually in the open hole. For example, in Kentucky, the surface hole is drilled with mud and surface pipe set to close off surface water sands. Below the surface pipe, the hole is typically drilled with air, either by using a cable tool rig or an air rotary rig. If a productive section is encountered, the well begins to produce through the baloee line so that the amount and type of production can be estimated. If it is desired to complete a well in this section, the bit is removed from the hole, and tubing is run into the well. A hook wall packer is seated against the wall of the bore hole and the well is produced up the tubing string in a somewhat unusual manner which happens to be typical for this area. Such wells may be acidized merely by pumping acid down the tubing in the expectation that the acid will enter the formation somewhere between the bottom of the packer and the bottom of the hole. Since wells completed in this fashion typically produce from the bottom of the hole, there is adequate control over the location where the acid is injected.

At one time, perhaps fifty years ago, it was common to stimulate wells in the open hole by shooting them with nitroglycerin. This technique has now been substantially wholly displaced in most petroleum producing areas by hydraulic fracturing in cased holes.

As alluded to, there are a variety of formation stimulation techniques known and practiced in the oil field. Of chemical techniques, acidizing is by far the most common. Of the mechanical techniques, the early nitroglycerin shooting has been displaced by hydraulic fracturing. Another mechanical technique involves the generation of large quantities of relatively high pressure gas in the bore hole. This gas generation type approach liberates the gas at a location adjacent the formation to be fractured. Because the evolved gases take the path of least resistance, they flow into the formation desired to be stimulated. The duration of gas evolution of prior art tools is relatively short, mainly because the quantity of propellent material that can be lowered into the well is quite limited because of the necessarily small internal diameter of casing in the well.

This invention relates to a development in a gas generation type technique for fracturing or stimulating a subterranean formation which is typically productive of oil or gas. In the technique of this invention, the operation is conducted in the open hole. Consequently, a much larger quantity of gas generating or propellent material may be employed since the bore hole diameter is necessarily substantially larger than casing or tubing through which the prior art gas generating type tools have had to pass. As an example, a typical bore hole is drilled with a bit $7\frac{7}{8}$ inches in diameter into which $4\frac{1}{2}$ inch O.D. casing is cemented. The internal diameter of $4\frac{1}{2}$ inch pipe is approximately 4 inches Because of the necessary clearances that must be allowed, the largest tool that can be run in $4\frac{1}{2}$ inch casing is not greater than about $3\frac{1}{2}$ inch. Because the amount of propellent material that may be placed in a well is proportional to the square of the diameter, it will be seen that considerably more material may be placed in the open hole than can be placed inside casing.

Rather than merely increasing the size of the prior art gas generation type fracturing tools, which are run into a well on a wire line, this invention contemplates the assembly of the tool inside the well at a location adjacent where fracturing is to occur. In the event the fracturing location is at the bottom of the well bore, an ignitor is placed at the bottom of the hole, either by dropping it into the well or by suspending it in the hole from a wire line. The propellent charge, which is made up of fuel and oxidizer, is delivered into the well either by pumping it through a pipe string suspended in the well, by dumping the material into the top of the well or the like. After the propellent charge accumulates at the bottom of the hole, the ignitor is actuated in any suitable manner to ignite the fuel of the propellent charge. The fuel and oxidizer react to generate a large quantity of high pressure gaseous combustion products which rapidly flow into the formation to be fractured. Because of the quite high gaseous velocities, sufficient fracturing occurs in the formation to increase the productivity of the well.

One of the unusual aspects of this invention lies in the nature of fluids which occur in the well bore. A well bore is almost never completely free of liquids, usually liquid hydrocarbons or water. This presents a very unusual aspect to the practice of this invention since it is normally believed that it is necessary to keep the fuel and oxidizer dry in order to allow combustion. For example, the old bromide states "keep your powder dry." Because water or liquid hydrocarbons will almost always seep or flow into the bottom of the well, it will be very difficult, if not impossible, to assemble the stimulating tool of this invention in a well under completely dry conditions. It may be thought that this would create insurmountable difficulties in igniting the gas generating charge of this invention. Instead, the presence of a liquid in the well bore provides a very advantageous side effect.

Ignition of the fuel component of the gas generating charge of this invention occurs by the use of a heat source which is sufficient to raise the temperature of the fuel, adjacent the ignitor, above its ignition temperature. Under most conditions, this temperature is substantially above the boiling point of water or liquid hydrocarbons present in the well, at least adjacent the ignitor. When the ignitor creates an ignition temperature, the liquid therearound vaporizes and allows the fuel to reach its ignition temperature. Accordingly, fuel immediately adjacent the ignitor begins to combust thereby generating large quantities of high pressure gaseous products used in the fracturing technique. As the fuel immediately adjacent the ignitor begins to burn, a large quantity of heat is generated thereby vaporizing additional bore hole liquid in the vicinity of the burning fuel particles. This necessarily raises the temperature of the area surrounding the burning fuel particles which acts to ignite additional fuel particles. It will accordingly be seen that combustion of the fuel continues until all of the fuel is consumed.

The presence of the liquid in the bore hole has an important advantage since it reduces the rate of combustion thereby lengthening the overall combustion time of the propellent charge. This is quite desirable since it is known, in the use of gas generating tools, that the longer the duration of combustion, the greater the increase in the productivity of the formation. Accordingly, the liquid in the bore hole acts as a moderator of the rate of combustion.

The disclosure of gas generating type stimulation tools are found in U.S. Pat. Nos. 3,422,760; 4,064,935 and 4,081,031. As will be evident, these patents disclose gas generating tools which are lowered into a well on a wire line and which afe ignited while connected to the wire line.

It is an object of this invention to provide a new and improved technique for stimulating a subterranean formation.

Another object of this invention is to provide a technique for stimulating a subterranean formation in the open hole by the use of a gas generating charge which combusts and thereby evolves a large quantity of high pressure gaseous combustion products.

Other objects and advantages of this invention will become more fully apparent as this description proceeds, reference being made to the accompanying drawings and appended claims.

IN THE DRAWINGS

Figure 1:
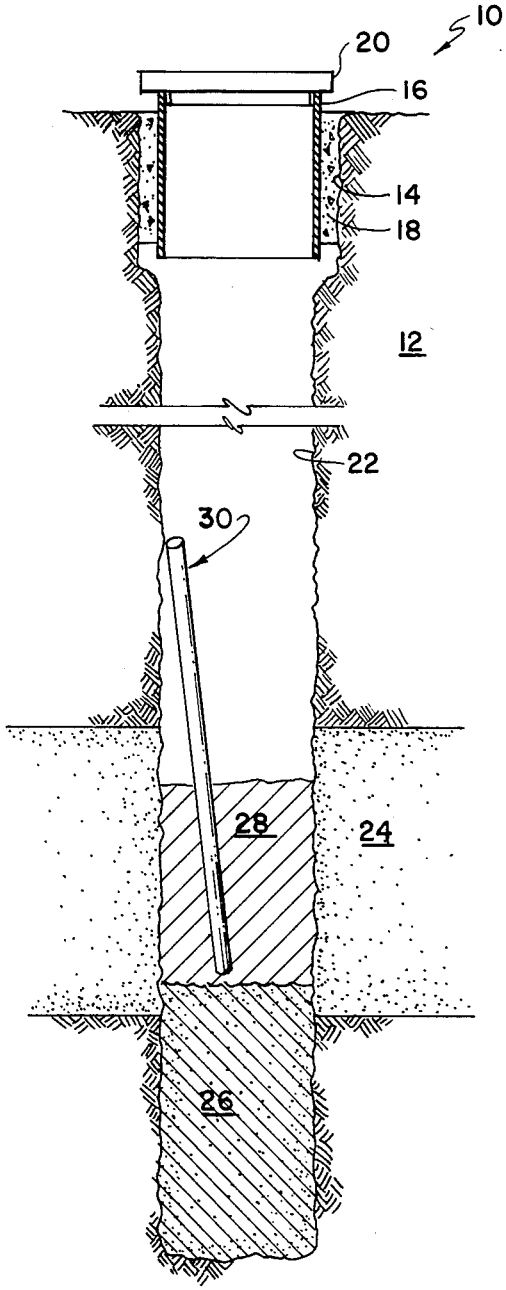
FIG. 1 is a view, largely in section, of a well extending into the earth having, a formation which is to be stimulated by the technique of this invention.
Figure 2:
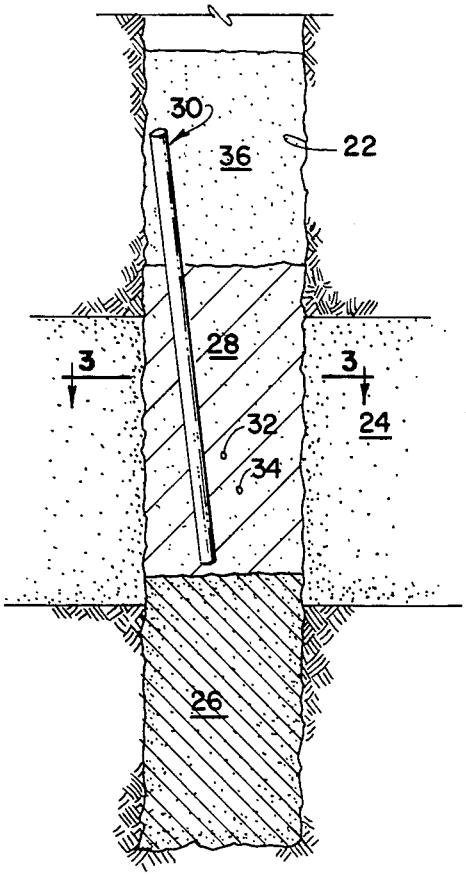
FIG. 2 is a view similar to FIG. 1 illustrating the well and an assembly of components which are ready to be activated to fracture the formation by the technique of this invention.

Referring to FIGS. 1 and 2, there is illustrated a well 10 extending into the earth 12. As is conventional, the well 10 has been drilled by first drilling a surface hole 14 into which surface casing 16 has been cemented by a cement sheath 18. The well head, blowout preventer or other pressure control equipment 20 may be attached to the exposed end of the surface pipe 16 as will be appreciated by those skilled in the art.

Below the surface pipe 16, the well 10 has been drilled with a bit to produce an uncased bore hole 22 which extends into or through a hydrocarbon bearing formation 24 which is desired to be stimulated. The formation 24 may be of the type which includes matrix porosity, such as sandstone, siltstone, dolomite, dolomitized limestone, weathered limestone, or the like. In addition, the formation 24 may be of the type in which the mobile hydrocarbons are contained in fractures. Such formations are exemplified by the Austin Chalk of South Texas and the Devonian shale of Kentucky and West Virginia.

If the well 10 were drilled to produce the formation 24, the well would be bottomed in the formation 24. Instead, FIG. 1 illustrates that the bore hole 22 extends substantially below the bottom of the formation 24. It is desirable, in the conduct of this invention, that the bottom of the bore hole 22 be in or near the bottom of the formation 24. To this end, a plug 26 fills the bottom of the bore hole 22 to a level adjacent the bottom of the formation 24. The plug 26 may be of any suitable material, such as cement, sand or the like.

As mentioned previously, one of the difficulties encountered in creating an open hole stimulating tool resides in the accumulation of formation liquid 28 in the bottom of the bore hole 22. The formation liquid 28 is typically water, hydrocarbons or a mixture thereof. If the liquid 28 is hydrocarbons, or partially hydrocarbons, it may serve as part of all of the fuel of the gas generating assembly of this invention.

It may be desirable to determine the location of the top of the liquid 28. This may be accomplished by conventional wire line pressure measuring instrument which are commonly used in the oil field to determine the bottom hole pressure of oil or gas wells. Such pressure instruments are capable of measuring the pressure in the bore hole 22 to within 0.1 psi. With instruments of such sensitivity, it is easy to detect the top of the liquid 28.

For purposes of illustration, it is assumed that the gas-liquid interface is at or near the top of the formation 24 as illustrated in FIG. 1. An ignitor 30 is positioned in the bore hole 22 adjacent the formation 24. The ignitor 30 may be lowered into the well 10 on a wire line or may simply be dropped into the well 10. In the absence of centralizers (not shown) the ignitor will not be located in the exact center of the bore hole 22 but will instead be somewhat inclined, as illustrated.

As will be more fully explained hereinafter, the ignitor 30 is basically a heat source which is sufficient to raise the temperature of the fuel-oxidizer mixture immediately adjacent thereto to a level above the ignition temperature of the fuel. Because the pressure in the bore hole 22 is normally rather low, the ignition temperature of the fuel is typically substantially above the boiling point of the liquid 28.

In FIG. 1, the ignitor 30 is illustrated as being somewhat longer than the vertical extent of the formation 24. As will be pointed out more fully hereinafter, the length of the ignitor 30 relative to the quantity of fuel-oxidizer has an effect on the mechanics and rate of combustion of the fuel-oxidizer charge.

The ignitor may be any suitable heat source which is sufficient to raise the temperature of the mixture in the bore hole above the ignition temperature of the fuel component therein. Manifestly, the exterior of the ignitor must be such that it is not attacked by the well bore liquid 28. To this end, the ignitor 30 may comprise a thin wall aluminum tube filled with a propellent charge. In the alternative, the ignitor 30 may comprise a gas generating type fracturing tool presently commercially available from Servo Dynamics, Inc. of Corpus Christi, Tex. Those skilled in the art will appreciate that numerous different types of ignitors might be employed such as phosphorous materials, thermite grenades and the like.

The ignitor 30 may be actuated in any suitable manner. Conveniently, the ignitor 30 may include a radio frequency receiver and battery which act to actuate the ignitor 30 upon receiving a radio frequency signal delivered down the well bore 22. In the alternative, the ignitor 30 may be of the time delay type which ignites after the passage of a predetermined time.

After the ignitor 30 has been placed in the liquid 28, a quantity of flowable material comprising fuel and oxidizer components 32, 34 are delivered into the bottom of the well bore 22 into the liquid 28. The fuel 32 may be a liquid, a mixture of liquids, a mass of solid particles, or mixtures thereof. Likewise, the oxidizer 34 may be a liquid, a mixture of liquids, a mass of solid particles or a mixture of liquids and solids.

The function of the ignitor 30 is to deliver sufficient heat into the mixture surrounding it so as to vaporize part of the liquid 28 adjacent the ignitor 30 and elevate the temperature of fuel particles around the ignitor 30 to a temperature above the fuel ignition temperature. Thus, the ignitor 30 merely starts the combustion of the material in the bottom of the well 10. In order to keep the combustion going, the fuel-oxidizer mixture must be such as to keep the combustion process going. Specifically there is a requirement for a substantial amount of heat in order to continue to vaporize the liquid 28 in the vicinity of the combustion front in order to raise the temperature of the fuel components 32 above their ignition temperature. Of course, if the liquid 28 is liquid hydrocarbons, it will vaporize and then combust in a manner that is rather satisfactory.

If the fuel and oxidizer components 32, 34 are liquid, they may be delivered into the bottom of the bore hole 22 by pumping them through a tubing string (not shown). If the fuel and oxidizer components 32, 34 are solids, they may be slurried and then pumped into the well bore or may merely be dumped into the top of the well 10 through the equipment 20. In any event, the fuel and oxidizer components 32, 34 accumulate in the bottom of the bore hole 22 raising the level of the liquid 28 substantially.

After the assembly of FIG. 2 has been completed, the ignitor 30 is energized to produce a substantial amount of heat. The heat evolved by the ignitor 30 is sufficient to raise the temperature in a zone 38, concentric with the ignitor 30, to a value greater than the ignition temperature of the fuel 32. Under normal pressures occurring in the well bore 22 prior to ignition, this temperature is sufficient to vaporize the formation liquid 28 in the zone 38. Accordingly, the ignitor 30 initiates combustion of the fuel 32 in the zone 38.

Figure 3:
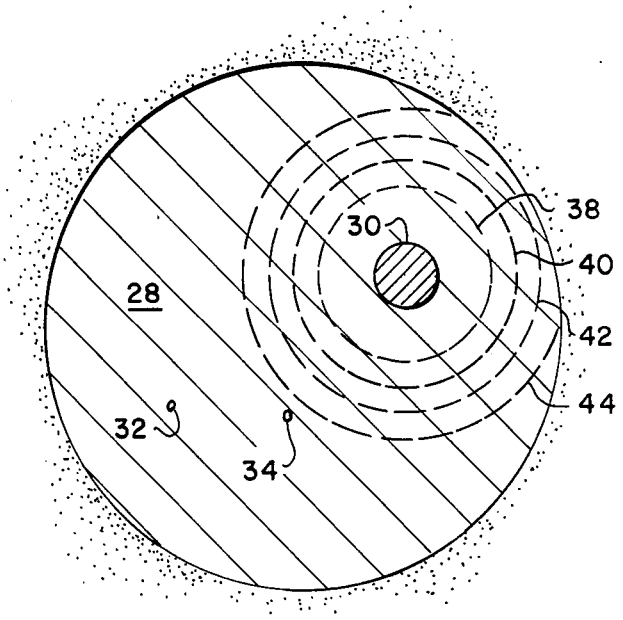
FIG. 3 is an enlarged cross-sectional view of the well of FIG. 2, taken substantially along line 3—3 as viewed in the direction indicated by the arrows.

Combustion in the first zone 38 has two effects. First, there is evolved a substantial quantity of hot, high pressure gaseous combustion products which ultimately pass into the formation 24 to increase the productivity thereof. Second, the temperature in a zone 38 is sufficient to heat a second zone 40 above the ignition temperature of the fuel 32 therein and to vaporize the formation liquid 28. It will accordingly be seen that the combustion of the fuel-oxidizer charge in the well bore 22 proceeds, in a radial fashion, through a multiplicity of increasingly larger diameter zones 38, 40, 32, 44 and so on. It will be appreciated, of course, that the pattern shown in FIG. 3 is stylized and is a conceptual explanation of what is believed to be occurring in the bore hole 22 during combustion of the fuel-oxidizer charge. Applicant is, of course, not bound by any theory of the combustion occurring during the practice of this invention.

When the fuel and oxidizer combusts, a large quantity of gaseous combustion products evolve. In order to fracture or stimulate the formation 24, a substantial portion of these gaseous products must be directed into the formation 24. It will be fruitless, of course, to allow all of these products to move upwardly through the well bore 22. In the prior art, gas generating tools are ignited under a substantial liquid column, e.g. 1000–2000 feet of water, lease crude, diesel or the like. Since the combustion time of prior art tools is quite short, for example less than three seconds, the inertia of the liquid cushion is sufficient to require substantially all of the evolved gaseous products to pass into the formation being stimulated.

In the technique of this invention, the elapsed combustion time is substantially longer than in prior art tools for two reasons. First, because of the geometry of the bore hole 22, a larger quantity of fuel and oxidizer may be delivered into the bottom of the hole as compared to what can be run on a wire line inside a cased hole or through tubing. Second, because of the moderating effect of the liquid 28 on the combustion process, the rate of combustion is somewhat slower. For these reasons, it is necessary to provide some type of cushion or buffer on top of the fuel-oxidizer mixture. The simpliest technique is merely to dump a quantity of sand 36 into the well. Even though the sand 36 is permeable, a large proportion of the gases evolved from the fuel and oxidizer are delivered into the formation 24, presumably because the elapsed time of combustion is so short that the longer path through the sand 36 is not the path of least resistance. In the alternative, a water cushion is acceptable as in the prior art.

Figure 4:
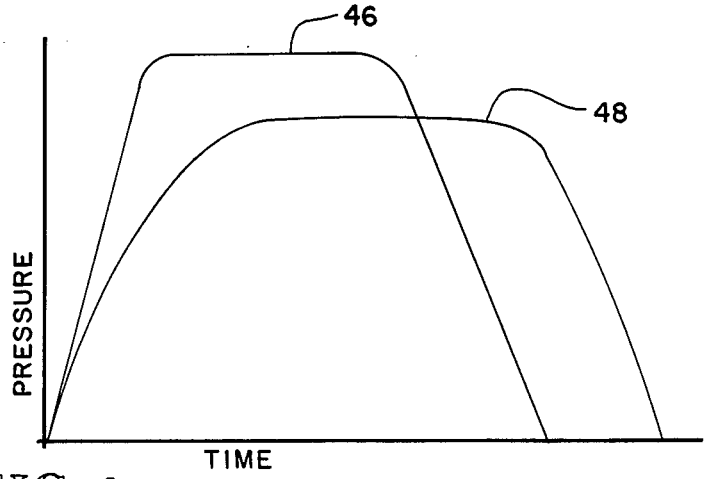
FIG. 4 is a graph illustrating the pressure-time relationship utilizing a gas generating charge.

As mentioned previously, one of the side effects of the formation liquid 28 is a moderation of the combustion rate during the consumption of the fuel and oxidizer 32, 34. The presence of the liquid 28 must reduce the combustion rate since some of the heat generated goes to vaporizing the liquid 28 rather than elevating the temperature of the fuel particles 32 in the approaching zone of combustion. This may be seen in FIG. 4 where the curve 46 illustrates the pressure-time relationship during a typical fracturing operation utilizing a gas generating charge of predetermined size. The curve 48 illustrates the pressure-time relationship using the same size charge during the technique of this invention. In this invention, the combustion rate is slower due to vaporization of the liquid 28. In addition, a greater quantity of gas is produced from the same sized charge because of the steam or vapor produced by the liquid 28.

Figure 5:
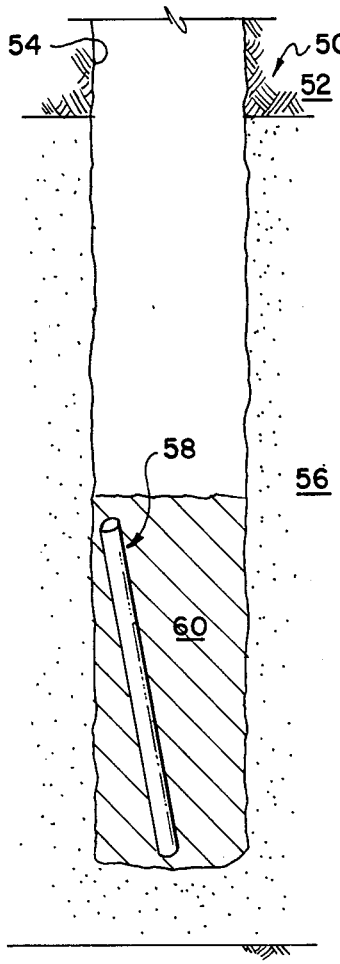
FIG. 5 is a longitudinal cross-sectional view of a well extending into the earth illustrating another embodiment of this invention.

Referring to FIG. 5, there is illustrated a somewhat more sophisticated embodiment of the technique of this invention. In FIG. 5, a well 50 is illustrated as penetrating the earth 52 and includes an uncased bore hole 54 extending into a hydrocarbon bearing formation 56 which is to be stimulated. An ignitor 58 is placed in the bottom of the bore hole 54. It will be seen that the vertical height of the formation 56 is substantially greater than the vertical height of the ignitor 58. A quantity of formation liquid 60 typically resides in the bottom of the bore hole 54.

Figure 6:
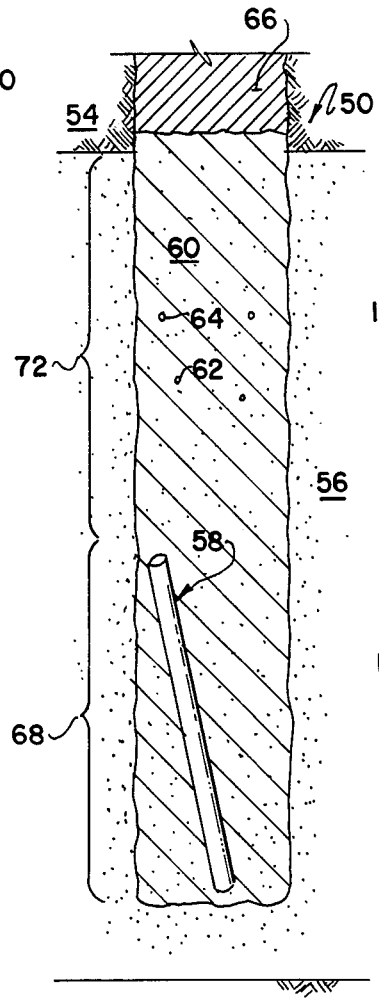
FIG. 6 is a view similar to FIG. 5 illustrating the well and an assembly of components that are ready to be activated to fracture the formation by the technique of this invention.

As shown in FIG. 6, a quantity of fuel and oxidizer components 62, 64 are delivered into the bottom of the bore hole 54. A suitable tamping material 66, such as sand or water, may be placed on top of the fuel-oxidizer mixture.

Figure 7:
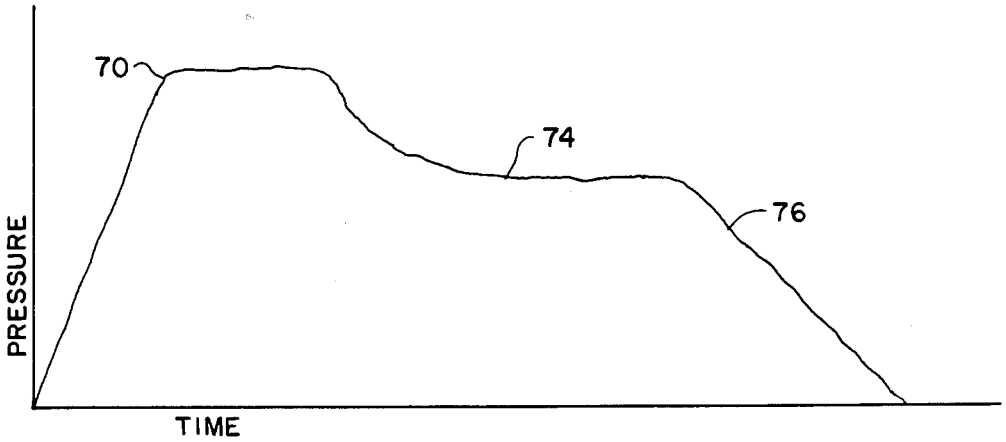
FIG. 7 is a graph illustrating the pressure-time relationship produced by the technique of FIGS. 5 and 6.

When the ignitor 58 is energized, an initial combustion zone 68 is created which experiences radial combustion, i.e. the combustion front progresses radially away from the axis of the ignitor 58. As shown in FIG. 7, this creates a relatively sharp rise in pressure until a maximum value 70 is achieved at about the time that the radial combustion process ends. After the fuel and oxidizer in the combustion zone 68 is consumed, a zone 72 begins to combusts in an axial direction. Since the rate of combustion in the axial direction is slower than in the radial direction, the pressure generated subsides. The axial or cigarette burn in the combustion zone 72 causes a relatively long relatively high pressure period 74, lower than the maximum pressure value 70. As the fuel-oxidizer mixture is exhausted, the pressure adjacent the formation 56 declines along a line 76.

One of the peculiarities of the embodiment of FIGS. 5 and 6 is that the propellent column located above the thermal ignitor 58 acts as stemming. This portion of the propellent column serves as its own tamp until it has nearly been consumed in a vertical combustion direction. This process may take several seconds during which the gases generated are compelled to penetrate the formation selected for stimulation. A conventional tamp 66 of sand or liquid above the propellant may not be required.

Figure 8:
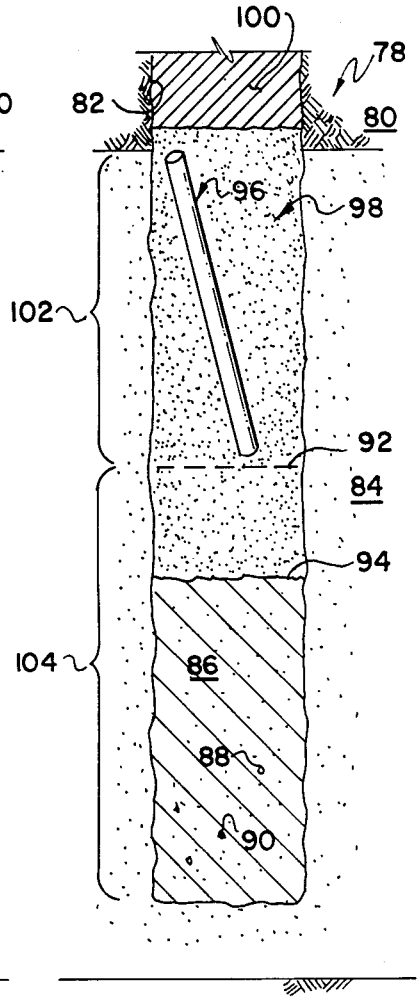
FIG. 8 is longitudinal cross-sectional view of a well and an assembly of components that are ready to be activated to fracture the formation by the technique of this invention.

Referring to FIG. 8, there is illustrated another embodiment of the technique of this invention and is a variation of the embodiment of FIGS. 5 and 6. In FIG. 8, a well 78 is illustrated as penetrating the earth 80 and includes an uncased bore hole 82 extending into a hydrocarbon bearing formation 84 which is to be stimulated. A quantity of formation liquid 86 may have accumulated in the bore hole 82. A quantity of fuel and oxidizer components 88, 90 have been delivered into the bore hole 82. It will be seen that the top 92 of the fuel-oxidizer mixture extends above the liquid level 94. An ignitor 96 is then placed in the bore hole 82 resting on the upper surface 92 of the fuel-oxidizer mixture.

A second quantity 98 of fuel-oxidizer mixture is then delivered into the bore hole 82 followed by a charge of tamping material 100, such as sand or water.

When the ignitor 96 is energized, there is created a first combustion zone 102 in which the combustion front propagates in a radial direction away from the axis of the ignitor 96. This causes a fairly rapid increase in pressure adjacent the formation 84 to produce a pressure-time curve similar to that shown in FIG. 7.

At about the time the fuel-oxidizer mixture is exhausted in the zone 102, progagation of the combustion front becomes axial in the combustion zone 104. Since combustion in the zone 104 is axial or similar to a cigarette burning, the combustion rate falls off to a slower rate. For a more complete description of the affect of the change of a radial combustion pattern to an axial combustion pattern, attention is directed to the disclosure of U.S. patent application Ser. No. 06/483,251, filed Apr. 8, 1983, now U.S. Pat. No. 4,530,396. entitled DEVICE FOR STIMULATING A SUBTERRANEAN FORMATION, the disclosure of which is incorporated herein by reference.

In the description of the previous embodiments, a number of assumptions have been made which may not be apparent and which warrant further amplification. If a dry granular propellant were placed in a well bore having no liquid therein, the hot combustion gases generated by burning of the propellant are able to migrate freely and at high velocity through the gas filled interstices between particles. This conceivably could cause excessive pressure and under some conditions progress to near detonation. On the other hand, if adequate liquid is provided to fill the interstices, a gas propagation between particles of propellant is blocked and the reaction and heat transfer is restricted to the thermal conductivity of the blocking fluid-granule mix. In the embodiments discussed in detail, the combustion process has been described as vaporizing the liquid. It is not essential that the liquids be vaporized. Indeed, under high enough hydrostatic heads, the vapor phase may not be reached. It will be evident to those skilled in the art that the temperature of the liquid, e.g. oil, water, mixtures thereof or some other liquid, may reach fuel ignition temperatures without boiling.

In order to achieve ignition, those skilled in the art will realize that a granular propellant must be heated above the ignition temperature of the fuel provided that oxygen is available at that temperature. In the event the oxidizer contains chemically bound oxygen, the temperature must be raised above the ignition temperature of the fuel as well as the temperature at which the oxidizer gives off oxygen. In the event a monopropellant is used, which contains the oxygen-fuel combination in the same molecule, the temperature has to be raised above the thermo-dynamically unstable bond threshold.

As suggested previously, mixtures of oxidizer and fuel or monopropellants may be used in pelletized form and conveyed in this form into the well.

This invention is not to be confused with bore hole heaters or the like in which a small amount of fuel is consumed to heat the bore hole for a variety of reasons, for example paraffin removal. The fracturing technique of this invention is easy to distinguish from mere bore hole heaters since the technique of this invention uses considerably more than a few pounds of fuel and oxidizer and generates in excess of 1000 psi on combustion in order to be effective to fracture a formation.

Although this invention has been described in its preferred forms with a certain degree of particularity, it will be seen that this disclosure is only by way of example and that numerous changes in the details of construction and in the combination and arrangement of parts may be resorted to without departing from the spirit and scope of the invention.

I claim:

1. A method of increasing the productivity of a subterranean formation penetrated by an uncased bore hole of a well, therebeing a quantity of formation liquid in the bore hole adjacent the formation, comprising positioning a thermal ignitor in the uncased bore hole of the well;

delivering a quantity of flowable material into the liquid in the uncased bore hole and creating a charge of fuel and oxidizer around the ignitor;

actuating the ignitor to heat the fuel above its ignition temperature thereby initiating combustion of the fuel in the uncased hole;

propogating a combustion front through the quantity of flowable material by progressively raising the temperature through the flowable material above its ignition temperature; and delivering high pressure combustion products from the charge into the formation.

2. The method of claim 1 wherein the positioning step comprises dropping the ignitor into the well and allowing it to gravitate toward the uncased bore hole of the well.

3. The method of claim 1 wherein the quantity of flowable material comprises a flowable mixture of fuel and oxidizer.

4. The method of claim 3 wherein the delivering step comprises pumping the flowable mixture into the well.

5. The method of claim 3 wherein the delivering step comprises pouring the flowable mixture into the well and allowing it to gravitate toward the uncased bore hole of the well.

6. The method of claim 1 wherein the actuating step comprises delivering a radio frequency signal into the well to activate the ignitor.

7. The method of claim 1 wherein the formation liquid comprises hydrocarbons and the quantity of flowable material comprises oxidizer.

8. The method of claim 1 wherein the formation liquid comprises water and the quantity of flowable material comprises fuel and oxidizer.

9. The method of claim 1 wherein the ignitor is positioned in the liquid in the uncased bore hole.

10. The method of claim 1 wherein the ignitor is positioned in the bore hole before delivering the flowable material therein.

11. A method of increasing the productivity of a subterranean formation penetrated by an uncased bore hole of a well, comprising positioning an elongate thermal ignitor in the uncased bore hole of the well adjacent the formation;

delivering a first quantity of flowable material into the uncased bore hole around the elongate ignitor and creating a first charge of fuel and oxidizer around the ignitor;

delivering a second quantity of flowable material into the uncased bore hole in combustion transmitting relation to the first quantity and creating a seond charge of fuel and oxidizer, the second charge of material being axially spaced from the first charge;

actuating the ignitor, thereby initiating combustion of the first charge of material and propagating a combustion front through the first charge of flowable material by progressively raising the temperature through the first charge of flowable material above its ignition temperature at a first rate in a radial pattern away from the ignitor; and igniting the second charge of flowable material from the first charge, thereby initiating combustion of the second charge and propagating a combustion front through the second charge of flowable material by progressively raising the temperature through the second charge of flowable material above its ignition temperature at a second rate, lower than the first rate, in an axial direction away from the ignitor.

12. The method of claim 11 wherein the first quantity is delivered into the well before the second quantity and the first charge resides below the second charge.

13. The method of claim 11 wherein the second quantity is delivered into the well before the first quantity and the second charge resides below the first charge.

14. The method of claim 11 wherein a quantity of formation liquid having hydrocarbons therein is located in the bore hole adjacent the formation and the fuel of at least one of the charges at least partially includes the hydrocarbons of the formation liquid.

15. A method of increasing the productivity of a subterranean formation penetrated by an uncased bore hole of a well, comprising positioning an elongate thermal ignitor in the uncased bore hole of a well adjacent the formation;

delivering a quantity of flowable material, comprising fuel and oxidizer, into the uncased bore hole around the elongate ignitor, the flowable material delivery step being separate from the ignitor positioning step;

delivering into the well a quantity of flowable tamping material on top of the ignitor and on top of the fuel and oxidizer for reducing upward of gaseous combustion products and promoting lateral flow of gaseous combustion products into the formation;

actuating the ignitor, thereby initiating combustion of the fuel and oxidizer and propagating a combustion front through the flowable material by progressively raising the temperature therethrough above its ignition temperature for generating a large quantity of high pressure gaseous combustion products; and delivering the high pressure gaseous combustion products into the formation.

16. The method of claim 15 wherein the tamping material comprises sand.

17. The method of claim 15 wherein the tamping material comprises water.

18. The method of claim 15 wherein the tamping material comprises an excess of the flowable material.

* * * * *